US007920039B2

(12) United States Patent
Shabany et al.

(10) Patent No.: US 7,920,039 B2
(45) Date of Patent: Apr. 5, 2011

(54) THERMALLY ENHANCED MAGNETIC TRANSFORMER

(75) Inventors: Younes Shabany, San Jose, CA (US); Juan Aguayo, San Antonio, TX (US); Srinivas Rao, Saratoga, CA (US)

(73) Assignee: Flextronics AP, LLC, Broomfield, CO (US)

( * ) Notice: Subject to any disclaimer, the term of this patent is extended or adjusted under 35 U.S.C. 154(b) by 0 days.

(21) Appl. No.: 12/284,934

(22) Filed: Sep. 25, 2008

(65) Prior Publication Data

US 2009/0079528 A1 Mar. 26, 2009

Related U.S. Application Data

(60) Provisional application No. 60/995,328, filed on Sep. 25, 2007.

(51) Int. Cl.
*H01F 27/08* (2006.01)
*H01F 5/00* (2006.01)
*H01F 27/28* (2006.01)

(52) U.S. Cl. ..... 336/61; 336/60; 336/200; 336/232

(58) Field of Classification Search ..... 336/60, 336/61, 200, 232
See application file for complete search history.

(56) References Cited

U.S. PATENT DOCUMENTS

| | | | | |
|---|---|---|---|---|
| 4,051,425 | A | 9/1977 | Smith | 363/86 |
| 4,712,160 | A | 12/1987 | Sato et al. | 361/388 |
| 4,788,626 | A | 11/1988 | Neidig et al. | 361/386 |
| 4,893,227 | A | 1/1990 | Gallios et al. | 363/26 |
| 4,899,256 | A | 2/1990 | Sway-Tin | 361/386 |
| 4,975,821 | A | 12/1990 | Lethellier | |
| 5,101,322 | A | 3/1992 | Ghaem et al. | 361/386 |
| 5,164,657 | A | 11/1992 | Gulczynski | 323/275 |
| 5,235,491 | A | 8/1993 | Weiss | 361/694 |
| 5,262,932 | A | 11/1993 | Stanley et al. | 363/26 |
| 5,295,044 | A | 3/1994 | Araki et al. | 361/709 |
| 5,490,052 | A | 2/1996 | Yoshida et al. | |
| 5,565,761 | A | 10/1996 | Hwang | 323/222 |
| 5,565,781 | A | 10/1996 | Dauge | 324/403 |
| 5,592,128 | A | 1/1997 | Hwang | 331/61 |
| 5,712,772 | A | 1/1998 | Telefus et al. | 363/21 |
| 5,742,151 | A | 4/1998 | Hwang | 323/222 |
| 5,747,977 | A | 5/1998 | Hwang | 323/284 |
| 5,798,635 | A | 8/1998 | Hwang et al. | 323/222 |
| 5,804,950 | A | 9/1998 | Hwang et al. | 323/222 |
| 5,811,895 | A | 9/1998 | Suzuki et al. | 307/125 |
| 5,818,207 | A | 10/1998 | Hwang | 323/288 |

(Continued)

OTHER PUBLICATIONS

EE Times.com—"Team Claims Midrange Wireless Energy Transfer", by R. Colin Johnson, 4 pages, Nov. 6, 2007.

(Continued)

*Primary Examiner* — Anh T Mai
*Assistant Examiner* — Ronald W Hinson
(74) *Attorney, Agent, or Firm* — Haverstock & Owens LLP

(57) ABSTRACT

A planar transformer comprises a laminate substrate having an opening with metal traces wound thereabout forming a primary and a secondary winding, a core configured to fit inside the opening to enclose the laminate substrate. At least one heat sink fin is integrally formed with the top, bottom or both sides of the core. A method of forming a planar transformer comprises laminating a substrate having an opening with metal traces wound thereabout forming a primary and a secondary winding, fitting a core inside the opening, and enclosing the laminate substrate. One of the top, bottom or both sides of the core include one or more heat sink fins.

21 Claims, 6 Drawing Sheets

U.S. PATENT DOCUMENTS

| | | | | |
|---|---|---|---|---|
| 5,870,294 | A | 2/1999 | Cyr | 363/41 |
| 5,894,243 | A | 4/1999 | Hwang | 327/540 |
| 5,903,138 | A | 5/1999 | Hwang et al. | 323/266 |
| 5,905,369 | A | 5/1999 | Ishii et al. | 323/272 |
| 5,923,543 | A | 7/1999 | Choi | 363/21 |
| 5,929,734 | A * | 7/1999 | Weiner | 336/61 |
| 6,058,026 | A | 5/2000 | Rozman | |
| 6,069,803 | A | 5/2000 | Cross | 363/21 |
| 6,091,233 | A | 7/2000 | Hwang et al. | 232/222 |
| 6,160,725 | A | 12/2000 | Jansen | 363/65 |
| 6,272,015 | B1 | 8/2001 | Mangtani | 361/707 |
| 6,282,092 | B1 | 8/2001 | Okamoto et al. | 361/704 |
| 6,344,980 | B1 | 2/2002 | Hwang et al. | |
| 6,396,277 | B1 | 5/2002 | Fong et al. | 324/402 |
| 6,449,162 | B1 | 9/2002 | Corbin, Jr. et al. | 361/719 |
| 6,459,581 | B1 | 10/2002 | Newton et al. | 361/700 |
| 6,469,980 | B1 | 10/2002 | Takemura et al. | 369/275.3 |
| 6,483,281 | B2 | 11/2002 | Hwang | 323/299 |
| 6,531,854 | B2 | 3/2003 | Hwang | 323/285 |
| 6,541,944 | B2 | 4/2003 | Hwang | 323/225 |
| 6,605,930 | B2 | 8/2003 | Hwang | 323/225 |
| 6,657,417 | B1 | 12/2003 | Hwang | 323/222 |
| 6,661,327 | B1 * | 12/2003 | Funk | 336/212 |
| 6,671,189 | B2 | 12/2003 | Jansen et al. | 363/21.14 |
| 6,674,272 | B2 | 1/2004 | Hwang | 323/284 |
| 6,879,237 | B1 * | 4/2005 | Viarouge et al. | 336/229 |
| 6,958,920 | B2 | 10/2005 | Mednik et al. | 363/19 |
| 7,047,059 | B2 | 5/2006 | Avrin et al. | 600/409 |
| 7,286,376 | B2 | 10/2007 | Yang | |
| 7,289,329 | B2 * | 10/2007 | Chen et al. | 361/707 |
| 2002/0011823 | A1 | 1/2002 | Lee | 320/137 |
| 2003/0035303 | A1 | 2/2003 | Balakrishnan et al. | 363/16 |
| 2004/0228153 | A1 | 11/2004 | Cao et al. | 363/71 |
| 2005/0105224 | A1 | 5/2005 | Nishi | 361/18 |
| 2005/0281425 | A1 | 12/2005 | Greuet et al. | 381/331 |
| 2007/0180684 | A1 * | 8/2007 | Wada et al. | 29/602.1 |

OTHER PUBLICATIONS

EE Times.com—"Wireless Bacon Could Recharge Consumer Devices", by R. Colin Johnson, 3 pages Nov. 6, 2007.

Hang-Seok Choi et al., Novel Zero-Voltage and Zero-Current—Switching (ZVZCS) Full bridge PWM Conveter Using Coupled Output Inductor, Sep. 2002 IEEE, pp. 641-648.

"New Architectures for Radio-Frequency dc/dc Power Conversion", Juan Rivas et al., Laboratory for Electromagnetic and Electronic Systems, Massachusetts Institute of Technology, Room 10-171 Cambridge, MA 02139, pp. 4074-4084, Jan. 2004.

Scollo, P Fichera R., "Electronic transformer for a 12V Halogen Lamp", Jan. 1999, ST Microelectronics pp. 1-4.

* cited by examiner

THERMALLY ENHANCED MAGNETIC TRANSFORMER

RELATED APPLICATIONS

This Patent Application claims priority under 35 U.S.C. §119 (e) of the U.S. Provisional Patent Application Ser. No. 60/995,328, filed Sep. 25, 2007, and entitled, "THERMALLY ENHANCED PLANAR MAGNETIC TRANSFORMER," which is also hereby incorporated by reference in its entirety.

FIELD OF THE INVENTION

The present invention relates generally to the field of planar transformers. More specifically, the present invention relates to thermal management for planar transformers.

BACKGROUND OF THE INVENTION

Power supplies have a limited minimum size that such electronic systems can attain, relying as they do on relatively large transformers with relatively large ferrite cores and magnet wire windings. Planar transformers ease this limitation and allow designers to achieve the low profiles required for circuit board mounting in space constrained applications. Connections to an outside circuit, such as the power semiconductors, are made by standard circuit board pins.

FIG. 1 shows a standard transformer 100. The transformer 100 comprises a winding spool 110. The winding spool 110 is configured to allow wire or cable (not shown) to be wound about the winding 110. Generally, there are at least two independent wires or cables wound about the spool 110 to effectuate the forming of secondary voltages from a primary voltage. It is generally known to those of ordinary skill that applying an alternating current voltage to a primary winding will generate an alternating current voltage on a secondary winding. A ratio between the number of turns of the primary winding and the number of turns of the secondary winding determines the ratio of amplitude between the signal applied to the primary and the signal measured from the secondary. Furthermore, multiple primary and secondary windings are generally employed for greater efficiency. The winding is mounted about a magnetic core 120 with extended sections 130. In some embodiments, a cap 140 is utilized to cover the transformer 100. Inputs and outputs 150 are electrically coupled to the primary and secondary windings to couple input and output signals from the transformer 100 to the outside world.

FIG. 2 shows the substrate layers 201-205 of a planar transformer. Although a planar transformer operates on the same basic principles as a standard transformer, its construction is different. Rather than wires around a core as described above for a standard transformer, these substrate layers have disposed thereupon copper traces 206 in a circular fashion about an opening 210. These traces perform essentially the same function as the wires in the standard transformer. When a primary voltage signal is applied to one set of inputs 211 that are electrically coupled to one set of copper traces 206, secondary voltage signals are formed at the outputs 215. The ratio of amplitude between the input and output is set by number of times the copper is wound about the opening. The substrates 201-205 are able to be any material that is convenient for mounting copper thereupon. In some embodiments, the substrate is a material such as FR4, a standard material in making circuit boards. Rather than mounting copper thereupon, pre-plated copper is able to be etched away by standard etching techniques.

FIG. 3 shows an exploded diagram of a standard planar transformer 300. In this exemplary embodiment, a core includes a top core 310, a central core 315 integrally formed thereupon and a bottom core 360. Alternatively, the central core 315 is able to be welded on or attached by another convenient means. The central core 315 is configured and properly sized to fit through an opening 320 in the laminate body 330 on which the copper traces (not shown) are disposed. A voltage is applied to a set of primary inputs 340. As mentioned above, the voltage signal causes the formation of various output signals based on the ratio of the number of turns between the primary and secondary windings. The planar transformer 300 is able to have at least one primary input 340 and at least one secondary output 350. The top core 310 is magnetically coupled to a bottom core 360. In this example, the inputs 340 and outputs 350 are in the form of through-hole pins. Alternatively, surface mount pads are able to replace the through hole pins.

However, given the compact size and planar configuration, planar transformers are often tightly packed into an area and come into thermal contact with other circuits, and the like. In such high temperature environments, it is important that the planar transformer have a thermal management system to prevent overheating and to enable cooling. Simply mounting a heat sink element to a planar transformer may not be satisfactory. The thermal performance of a mounted heat sink can be inadequate. Furthermore, the addition of a heat sink increases the number of steps to manufacture a system that has a planar transformer and will increase the cost of manufacturing such a device.

What is needed is a planar transformer that has enhanced heat transfer efficiency. What is also needed is a planar transformer that is easy to manufacture. What is additionally needed is a planar transformer that both has enhanced heat transfer efficiency and adds no additional manufacturing steps.

SUMMARY OF THE INVENTION

In one aspect of the invention, a planar transformer comprises a laminate substrate having an opening. Metal traces are wound about the opening to form a primary and a secondary winding. A core is configured to fit inside the opening and around the windings. At least one heat sink fin is integrally formed with the core. Because the core and heat sink are integrally formed, there is no additional step to mount the heat sink. Moreover, this eliminates the use of a thermal interface between the core and the heat sink making the assembly thermally more efficient than a system that has a heat sink mounted to the core. In some embodiments, the core comprises a ferrite ceramic. Alternatively, the core is iron or an iron alloy.

The central core is configured to pass through an aperture formed in a central position of the laminate substrate internal to the primary winding and the secondary winding. In some embodiments, the central core is integrally formed with a top core, and at least partially surrounds the primary winding and the secondary winding. Alternatively, a bottom core is configured to mount to the central core and the top core such that the core that comprises a central core, top core and bottom core substantially surrounds the primary winding and the secondary winding in the usual manner. In some embodiments, the bottom core couples with the top core and the central core to form an air gap for enhanced magnetic properties. When at least partially exposed to ambient air, the heat sink fins transfer heat from the planar transformer to the ambient air by convection.

In some embodiments, the top core comprises heat sink fins integrally formed thereon. Alternatively or additionally, the heat sink fins can be integrally formed with the bottom core.

The core and heat sink can be formed by machining. In some embodiments, the core including the heat sink fins is formed by extrusion. Certain embodiments can be formed by a combination of extrusion and post extrusion machining.

Materials for forming the core are selected for their magnetic properties. The heat transfer efficiency can vary according to the material of the core and heat sink. Certain metals such as copper or aluminum provide efficient heat transfer characteristics. Some materials that have significantly better magnetic properties can have poorer heat transfer efficiency than copper or aluminum. Furthermore, in some embodiments, the core comprises a coating or plating of a material having high thermal conductivity to provide both good magnetic and thermal properties.

In another aspect of the invention, a transformer comprises a bobbin, having an opening, a primary and a secondary winding around the bobbin, and a core configured to fit inside the bobbin. In some embodiments, the core is a ferrite ceramic. Alternatively, the core is iron or iron alloy. In some embodiments, the core comprises heat sink fins formed integrally thereon. In some embodiments, the core further comprise a coating of plating of a material having high thermal conductivity. In some embodiments, the core is formed by extrusion. Alternatively, the core may be formed by a combination of extrusion and post extrusion machining.

It can be appreciated by those of ordinary skill in the art that other embodiments of a transformer having a core with integrally formed heat sink fins are feasible. Such embodiments will readily present themselves as specific applications demand specific form factors, number of windings, number of inputs and number of outputs. Although achieving such embodiments can require experimentation, such experimentation will be within the understanding and capability of one of ordinary skill.

DETAILED DESCRIPTION OF THE INVENTION

An improved apparatus and improved techniques are shown relating to a planar transformer having enhanced thermal performance. Those of ordinary skill in the art will realize that the following detailed description of the present invention is illustrative only and is not intended to limit the claimed invention. Other embodiments of the present invention will readily suggest themselves to such skilled persons having the benefit of this disclosure. It will be appreciated that in the development of any such actual implementation, numerous implementation-specific decisions can be made to achieve specific goals. Reference will now be made in detail to implementations of the present invention as illustrated in the accompanying drawings. The same reference indicators will be used throughout the drawings and the following detailed description to refer to the same or like parts.

Figure 1:
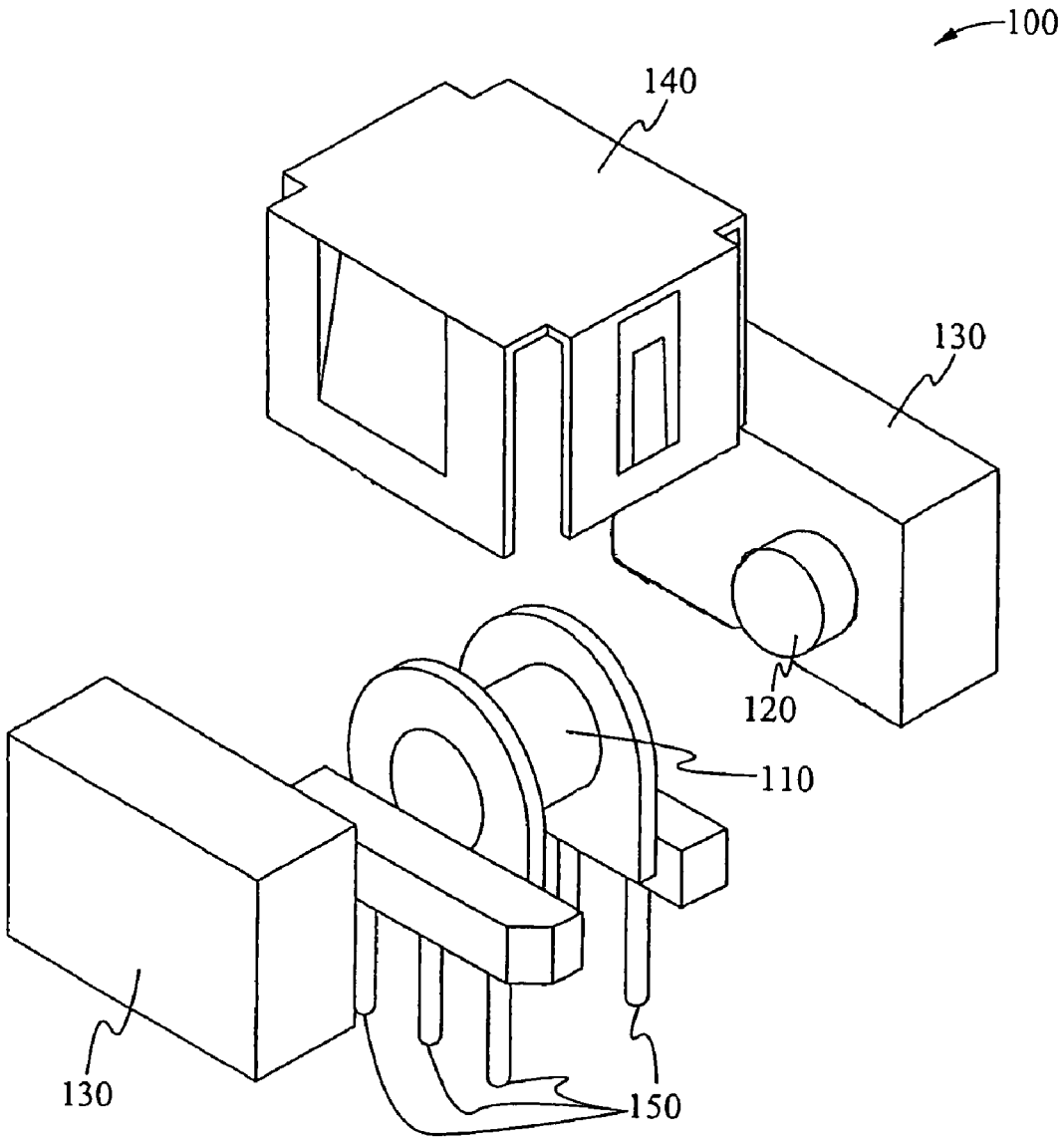
FIG. 1 shows a standard transformer.
Figure 2:
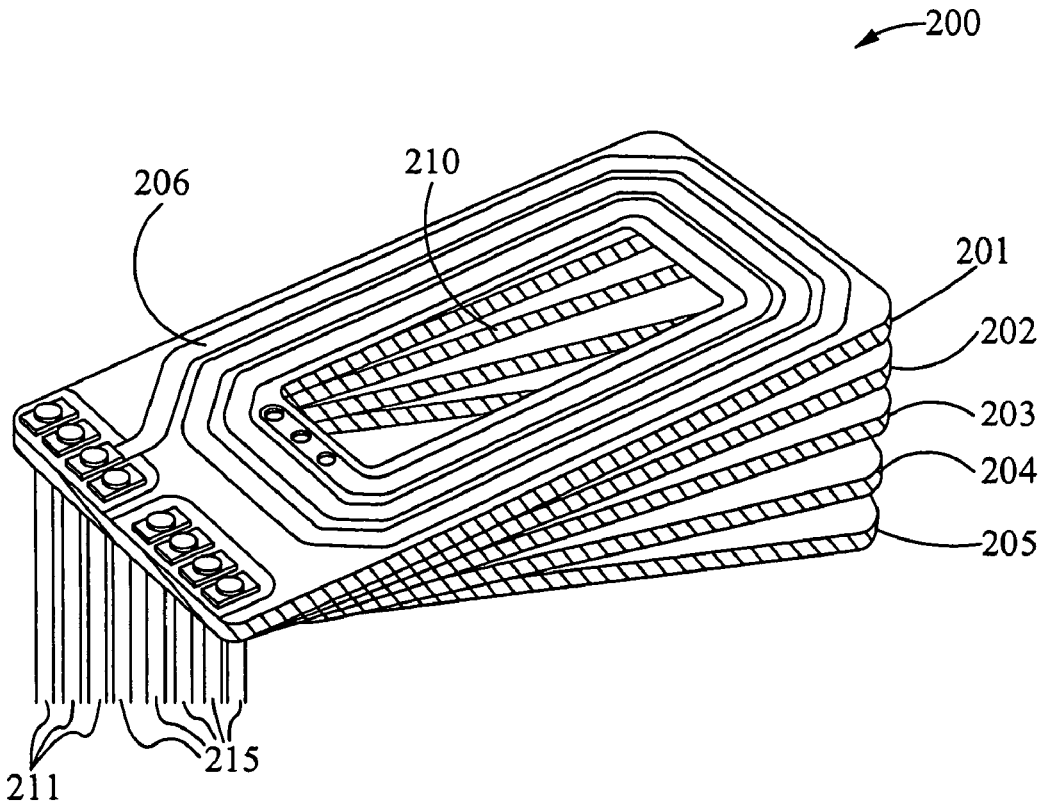
FIG. 2 shows layers of laminate substrate of a planar transformer.
Figure 3:
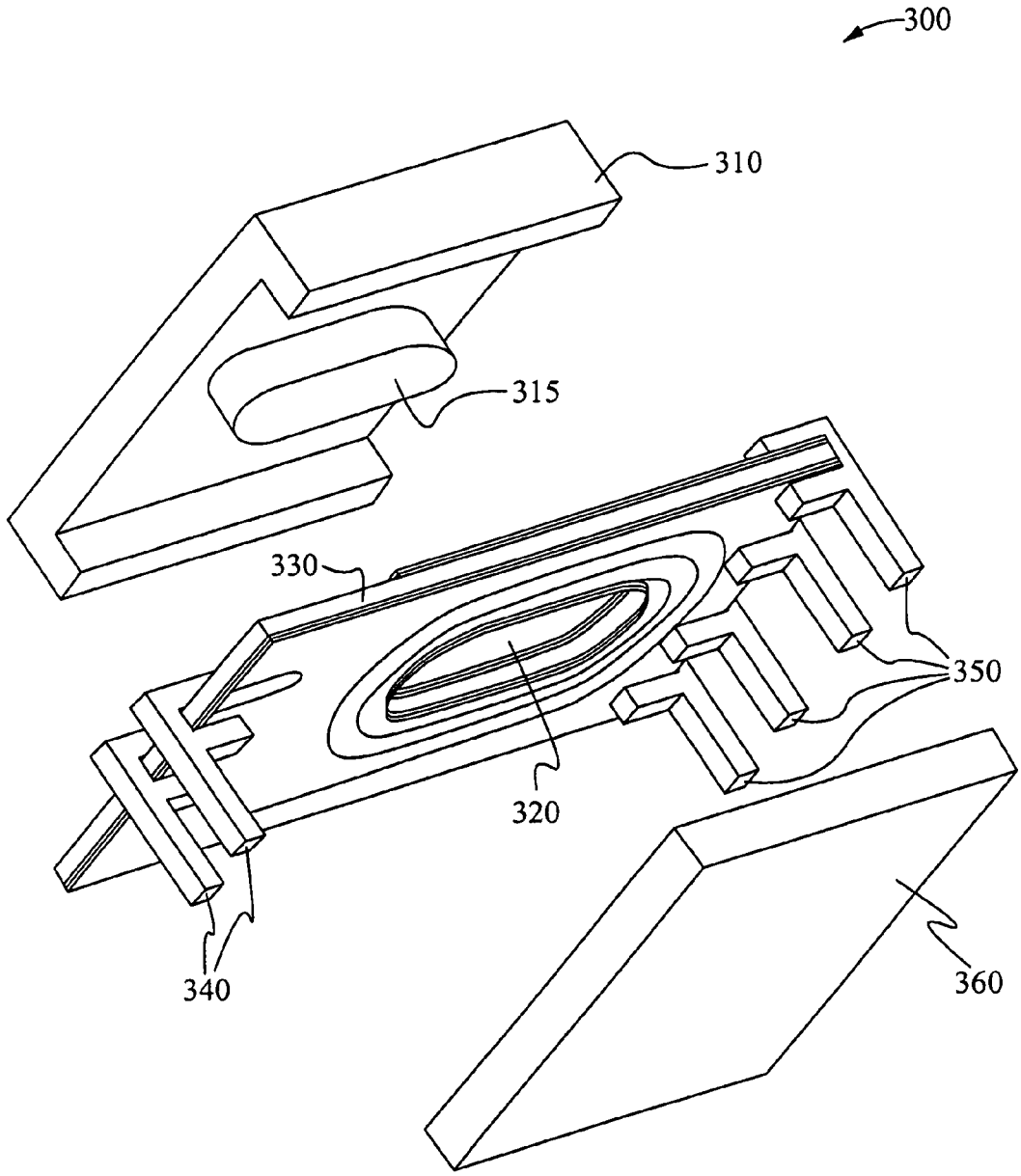
FIG. 3 shows an exploded planar transformer.
Figure 4A:
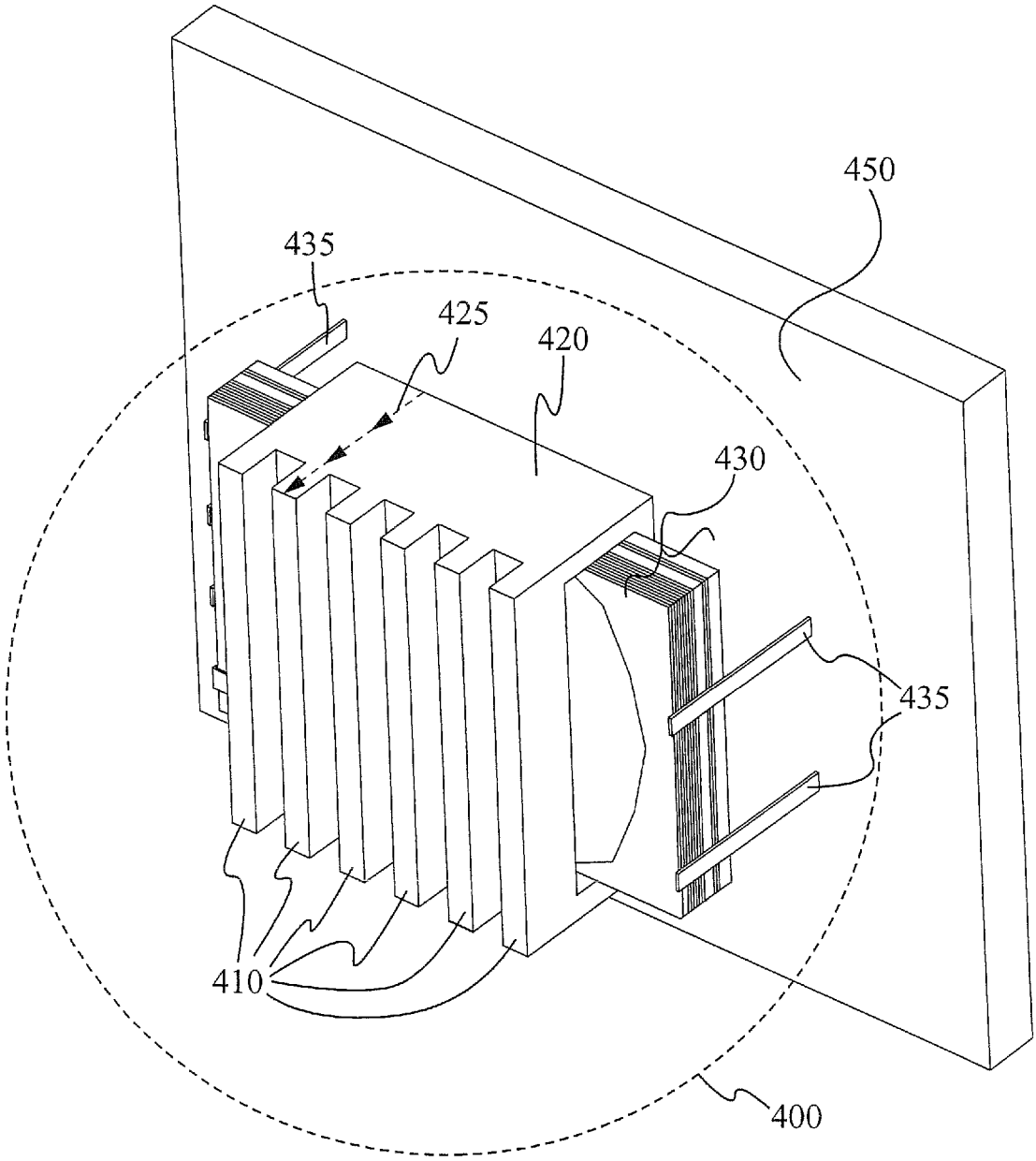
FIG. 4A shows a planar transformer having heat sink fins integrally formed on the top core.

Although transformers are generally efficient devices, they still generate some heat. The present invention is directed toward a more efficient means to remove that heat. FIG. 4A shows a planar transformer 400 having heat sink fins 410 disposed thereupon. In this exemplary embodiment, the heat sink fins 410 are integrally formed on top of the core 420. Advantageously, an uninterrupted thermal path (shown as a dotted line with arrows 425) is formed from the core 420 to the heat sink fins 410 for the heat to dissipate into the ambient. In this example, the core 420 and the heat sink fins 410 are concurrently formed by an extrusion process. The core 420 houses the laminate substrate layers 430 of the planar transformer 400. Alternatively, heat sink fins 410 are able to be formed on core 420 by welding. A skilled practitioner having the benefit of this disclosure will be able to size the fins 410 taking into account such parameters as air flow, space, ambient temperature and desired target temperature. In some embodiments, the core 420 comprises a ceramic. Alternatively, metal alloys having high heat distribution characteristics are able to be utilized, such as a manganese and zinc ferrite. Generally, a zinc ferrite comprises zinc, iron oxide, and other elements optimized for specific applications.

The planar transformer 400 further comprises input and output pins 435. In this example, the pins 435 are in the form of through-hole that mount on a PCB 450. Alternatively, surface mount pins are able to be utilized.

Figure 4B:
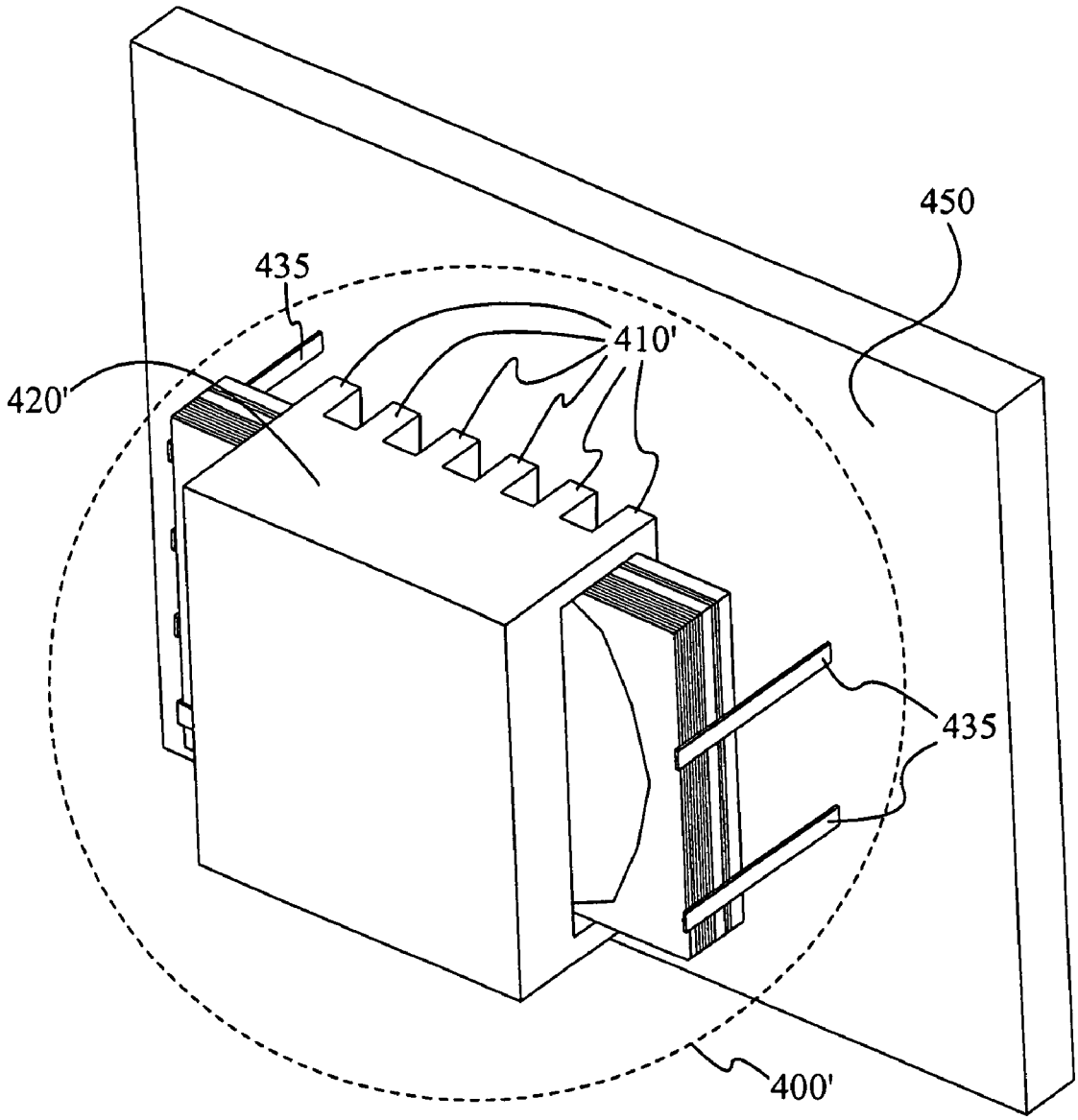
FIG. 4B shows a planar transformer having heat sink fins integrally formed on the bottom core.

FIG. 4B shows an alternate configuration to the one shown in FIG. 4A. In some embodiments, it is desirable to have the heat sink fins 410' that are integrally formed with the core 420' pointed toward the PCB 450. In some applications, a device to promote heat convection such as a fan or another cooling element is coupled to the PCB 450 on an opposite side that the transformer 400 is mounted on. Also, it is desirable to keep the heat produced by the transformer 400 away from other heat sensitive components within the system in which the transformer 400 is included. Also, the heat sink fins 410' between the transformer 400' and the PCB 450 occupy an already empty volume there and do not add to the total volume it occupies in the system.

Figure 4C:
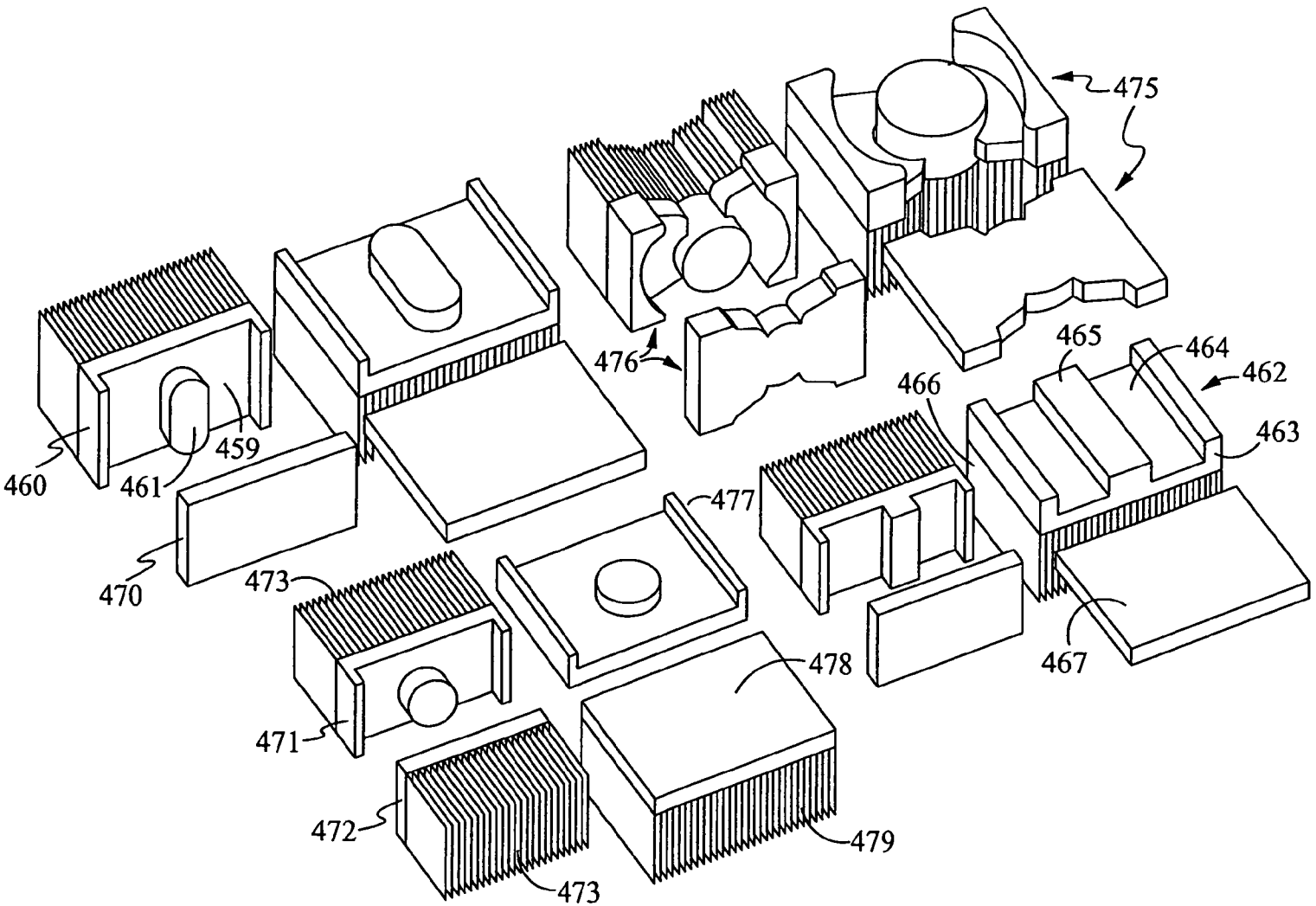
FIG. 4C shows examples of ferrite cores of planar transformers with heat sink fins.

FIG. 4C shows a variety of cores. The cores are able to be designed to accommodate any form factor desired for a given application. It will be apparent that alternative techniques can be used to manufacture the elements. In an embodiment, a top core element 462 includes exterior walls 463, a top plate 464, a central core 465 and heat sink fins 466. This core element can be formed in a single extrusion operation. Individual core elements 462 can be cut from a length of extruded material. A bottom core 467 can be extruded, machined or molded. In use, the core element 462 is mounted such that the central core 465 passes through the windings of the transformer while the walls 463 surround a portion of the windings. The bottom core 467 is mounted to the exposed surface of the walls 463 and the central core 465. A significant portion of the heat that is generated in a transformer using such a top core element 462 and bottom core 467 will be conducted to the heat sink fins 466 where it is dissipated by convection.

In an alternative embodiment, a top core member 460 is first formed by extrusion. The central core 461 is modified such as by a machining operation to obtain the desired shape. When a bottom core 470 is mounted to the top core element 460 the windings can reside between the top plate 459 and the bottom core 470.

In a further alternative, both the top core element 471 and the bottom core 472 have heat sink fins 473. In yet other alternative embodiments 475 and 476, the top core and bottom core members can be formed by extrusion, machining or by molding. In another embodiment, the top core element 477 has no heat sink fins, but the bottom core 478 has integrally formed heat sink fins 479.

The present application has been described in terms of specific embodiments incorporating details to facilitate the understanding of the principles of construction and operation of the planar magnetic transformers. Many of the components shown and described in the various figures can be interchanged to achieve the results necessary, and this description should be read to encompass such interchange as well. As such, references herein to specific embodiments and details thereof are not intended to limit the scope of the claims appended hereto. It will be apparent to those skilled in the art that modifications can be made to the embodiments chosen for illustration without departing from the spirit and scope of the application.

What is claimed is:

1. A planar transformer comprising:

a. a laminate substrate having an opening with metal traces wound thereabout forming a primary and a secondary winding;

b. a core having a top core configured to fit inside and surround the opening and a bottom core to mount to the top core;

c. at least one heat sink fin, wherein the at least one heat sink fin is integrally formed on the top core; and d. an uninterrupted and uniform heat conduction thermal path, wherein the thermal path extends from the top core to the at least one heat sink fin.

2. The planar transformer of claim 1 wherein the core comprises a ferrite ceramic.

3. The planar transformer of claim 1 wherein the core comprises iron.

4. The planar transformer of claim 1 wherein the core comprises a surface coating of a material having high thermal conductivity.

5. A planar transformer comprising:

a. a laminate substrate having an opening with metal traces wound thereabout forming a primary and a secondary winding;

b. a core having a top core configured to fit inside and surround the opening and a bottom core to mount to the top core;

c. at least one heat sink fin, wherein the at least one heat sink fin is integrally formed on the bottom core; and d. an uninterrupted and uniform heat conduction thermal path, wherein the thermal path extends from the bottom core to the at least one heat sink fin.

6. The planar transformer of claim 5 wherein the core comprises a ferrite ceramic.

7. The planar transformer of claim 5 wherein the core comprises iron.

8. The planar transformer of claim 5 wherein the core comprises a surface coating of a material having high thermal conductivity.

9. The planar transformer of claim 5 further comprising at least one heat sink fin, wherein the at least one heat sink fin is integrally formed on the top core.

10. A method of forming a planar transformer comprising:

a. laminating a substrate having an opening with metal traces wound thereabout forming a primary and a secondary winding;

b. mounting a core to the transformer, the core having a top core configured to fit inside and surround the opening and a bottom core to mount to the top core, wherein the top core has at least one integrally formed heat sink fin; and c. forming an uninterrupted and uniform heat conduction thermal path, wherein the thermal path extends from the top core to the at least one integrally formed heat sink fin.

11. The method of claim 10 wherein the core comprises a ferrite ceramic.

12. The method of claim 10 wherein the core comprises iron.

13. The method of claim 10 further comprising the step of coating a surface of the core with a material having high thermal conductivity.

14. A method of forming a planar transformer comprising:

a. laminating a substrate having an opening with metal traces wound thereabout forming a primary and a secondary winding;

b. mounting a core to the transformer, the core having a top core configured to fit inside and surround the opening and a bottom core to mount to the top core, wherein the bottom core has at least one integrally formed heat sink fin; and c. forming an uninterrupted and uniform heat conduction thermal path, wherein the thermal path extends from the bottom core to the at least one integrally formed heat sink fin.

15. The method of claim 14 wherein the core comprises a ferrite ceramic.

16. The method of claim 14 wherein the core comprises iron.

17. The planar transformer of claim 14 further comprising the step of coating a surface of the core with a material having high thermal conductivity.

18. The method of claim 14 further comprising at least one heat sink fin, wherein the at least one heat sink fin is integrally formed on the top core.

19. The planar transformer of claim 5, wherein the heat sink fin couples to a component containing PCB.

20. The method of claim 10 further comprising forming the top core containing the at least one integrally formed heat sink fin in an extrusion process.

21. The method of claim 14 further comprising forming the bottom core containing the at least one integrally formed heat sink fin in an extrusion process.

* * * * *